US011661154B2

(12) United States Patent
Moragon Martinez

(10) Patent No.: US 11,661,154 B2
(45) Date of Patent: May 30, 2023

(54) DEVICE FOR AUTOMATIC UNLASHING OF CARGO CONTAINERS

(71) Applicant: TEC CONTAINER S.A., Mejorada del Campo (ES)

(72) Inventor: Rafael Moragon Martinez, Mejorada del Campo (ES)

(73) Assignee: TEC CONTAINER S.A., Mejorada del Campo (ES)

( * ) Notice: Subject to any disclaimer, the term of this patent is extended or adjusted under 35 U.S.C. 154(b) by 328 days.

(21) Appl. No.: 16/762,991

(22) PCT Filed: Jun. 4, 2019

(86) PCT No.: PCT/ES2019/070381
§ 371 (c)(1),
(2) Date: May 11, 2020

(87) PCT Pub. No.: WO2020/002727
PCT Pub. Date: Jan. 2, 2020

(65) Prior Publication Data

US 2020/0277027 A1 Sep. 3, 2020

(30) Foreign Application Priority Data

Jun. 25, 2018 (ES) ..... ES201830978U

(51) Int. Cl.
*B63B 25/02* (2006.01)
*B65D 88/00* (2006.01)
*B63B 25/28* (2006.01)

(52) U.S. Cl.
CPC ..... *B63B 25/02* (2013.01); *B65D 88/005* (2013.01); *B63B 2025/285* (2013.01)

(58) Field of Classification Search
CPC ..... B63B 25/00; B63B 25/02; B63B 25/28; B63B 2025/285; B65D 88/005; B65D 90/002
(Continued)

(56) References Cited

U.S. PATENT DOCUMENTS 3,083,670 A * 4/1963 Harlander ..... B60P 7/13 114/201 R
3,552,345 A * 1/1971 Harlander ..... B63B 25/004 114/72
(Continued)

FOREIGN PATENT DOCUMENTS

DE 10059260 6/2002
DE 102008062854 7/2010
(Continued)

*Primary Examiner* — Daniel V Venne
(74) *Attorney, Agent, or Firm* — Defillo & Associates, Inc; Evelyn A. Defillo

(57) ABSTRACT

Specially designed to carry out unlocking shipping containers, eliminating the physical risks for port personnel, includes a telescopic load-bearing structure (1) that can be moved up with a port crane (3), and at its ends, pairs of lateral frames emerge (5-5') that have a robotic mechanism (6) on their inner faces, with at least three degrees of movement for a claw for catch onto the handles (11) for opening different types of securing mechanisms (12) of the container (13). The claw has at least one degree of freedom of movement, while the robotic mechanism (6) is assisted by artificial vision (14) and motion systems (16) that are remotely operated, assisted, or fully automatic.

2 Claims, 3 Drawing Sheets

(58) Field of Classification Search
USPC ..... 114/72, 73; 414/403
See application file for complete search history.

(56) References Cited

U.S. PATENT DOCUMENTS 4,294,185 A * 10/1981 Nordstrom ..... B63B 25/004
410/95
6,077,019 A * 6/2000 Corcoran ..... B63B 25/004
414/143.2

FOREIGN PATENT DOCUMENTS

WO WO 0218263 3/2002
WO WO2012141658 10/2012

* cited by examiner

DEVICE FOR AUTOMATIC UNLASHING OF CARGO CONTAINERS

CROSS REFERENCE TO RELATED APPLICATION

This application is a national stage entry of PCT/ES2019/070381 filed Jun. 4, 2019, under the International Convention claiming priority over Spanish Patent Application No. U201830978 filed Jun. 25, 2018.

FIELD OF THE INVENTION

This invention is a device that has been specially designed to facilitate unlocking shipping containers comfortably, easily, and, above all, safely.

The object of the invention is to eliminate the high physical risks involved until now in carrying out this type of operation for port personnel.

As such, the invention is in the field of shipping containers.

BACKGROUND OF THE INVENTION

As widely known and per the invention's practical application, shipping containers are stacked up on cargo ships so as to prevent them from falling, which could cause a swell, and the containers are attached to each other with automatic securing mechanisms, usually known as "twistlocks."

Even though these securing mechanisms are automatically locked during container stacking with the corresponding machinery, when the locks act against the tension of one or more of the springs, unlocking them requires pulling a lever or handle, which may have different configurations, but that in any case must be operated manually, until now.

As such, and knowing the great heights to which these containers may be stacked, the stevedores are subject to very high risks in these operations.

One solution to this problem is aerial work platforms, like the one described in document WO 0218263A1, as well as tools for unlocking, which are elongated accessories that facilitate getting to them, or unlocking mechanisms, even though this type of aerial platform is not meant for this operation. It must be added that these cannot always access the work area, given the limited space between stacks of containers.

In any case, these are partial solutions that continually expose stevedores to workplace hazards that are clearly not preferable.

DESCRIPTION OF THE INVENTION

The device for automatically unlocking containers laid out here addresses the set of problems in a completely satisfactory manner, allowing these unlocking maneuvers to be carried out in a totally safe way, whether that is remote-operated, assisted, or completely automated.

For this, the invention's construction is made of a horizontal telescoping frame, which can be moved up through any conventional machinery, such as a port crane. At its opposite ends are two separate frames, from which one or more lateral and vertical frames emerge to allow for the simultaneous unlocking of several containers.

More specifically, the telescoping frame allows adjusting the separation of the structure's side frames with respect to the width of the containers and connecting the whole set to the crane.

For vertical attachment of frames, the same automatic securing mechanisms or "twistlocks" used for stacking containers may be used to give the structure a modular character that is adaptable to specific needs in each case.

In any case, a robotic mechanism corresponding with the lower internal area of those lateral frames will be provided for the opening of the securing devices or twistlocks, and it is made up of a set of rigid links that are articulated with each other, offering at least three degrees of movement.

At the end of this mechanism, there is a grasping tool such as a claw with at least one degree of movement that is specially designed for catching onto the handles for opening different types of securing mechanisms.

The structure of this mechanism is designed to facilitate the relative movement of the tool with respect to the general structure of the lifting frame, as this movement is wide and fast enough to compensate for unexpected movement of the containers and the natural movement of the lifting frame as it moves around the stack of containers.

To carry out its purpose successfully, each robotic mechanism operates independently and simultaneously with the movement of the lifting frame. As such, any robotic mechanism is capable of executing four basic tasks:

1. Tracking, which consists of inspecting the sides of the containers in search of securing mechanisms, where the robotic mechanism takes advantage of the natural movement of the lifting frame and its own ability to move.
2. Identification, which aims to detect the opening systems of securing mechanisms and to obtain a set of spatial coordinates that will guide the robotic mechanism's movements.
3. Capture, which seeks to position the grasping tool properly on the securing mechanism previously identified, and then use the tool in order to grip the opening handle.
4. Unlocking, which consists of executing a set of maneuvers that ensure properly opening the securing mechanism captured.

Properly performing these four tasks is achieved with two internal systems: artificial vision and motion control. The artificial vision system includes a set of components and methods designed to acquire, process, and analyze images of the environment where each robotic mechanism is located to produce information that may then be processed. Likewise, the motion control system is made up of a set of actuators, sensors, and controllers whose purpose is allowing the links of the robotized mechanism to move under certain kinematic conditions.

As for the robot's vision and motion system, it may be integrated in three different ways, depending on the type of operation: guided action, visual servoing, or a visual hybrid, which combines the first two methods.

As for how it is operated, three possibilities have been projected:

Remote operation: in this method, a crane operator controls the movement of a lifting frame that supports the robotic opening mechanism for the securing mechanisms, while one or more stevedores guide the opening of those mechanisms from a safe place at the port. The stevedores have the images captured by each system's vision system, and there is the opportunity to interact with the vision system, facilitating the tasks of tracking and identification. In addition, stevedores can also send orders to the motion system to complete the capturing and unlocking operations of the securing mechanisms successfully.

With this mode of operation, most of the decisions are made by stevedores, and the vision and motion systems are fundamentally for facilitating decision-making and ensuring the possibility of operating in a safe environment.

Assisted operation: as in the previous case, a crane operator controls the movement of the lifting frame, but here, the stevedores supervise the process of opening the securing mechanisms. The stevedores usually work with calibrating the vision system, confirming the location of the target securing mechanisms, or requesting to reopen the securing mechanisms. However, many of the tasks related to tracking, capturing, and unlocking are performed directly by the vision and motion systems.

Automatic operation: with this mode of operation, the robotic opening mechanism for the securing mechanisms sends the instrumentation signals needed to guide the crane's movement, which can serve as a support for the crane operator or even as a reference to guide the lifting frame's automatic movement. Furthermore, all of the system's tasks which lead to opening the securing mechanisms (tracking, identification, capture, and unlocking), can be carried out independently, without the need for human operators.

BRIEF DESCRIPTION OF THE DRAWINGS

To complement the description ahead and to help improve understanding of the invention's characteristics, per an ideal model of its practical implementation, a set of drawings is included. These constitute an integral part of this description, and they show the following, for purposes including but not limited to illustration.

PREFERRED EMBODIMENT OF THE INVENTION

Figure 1:
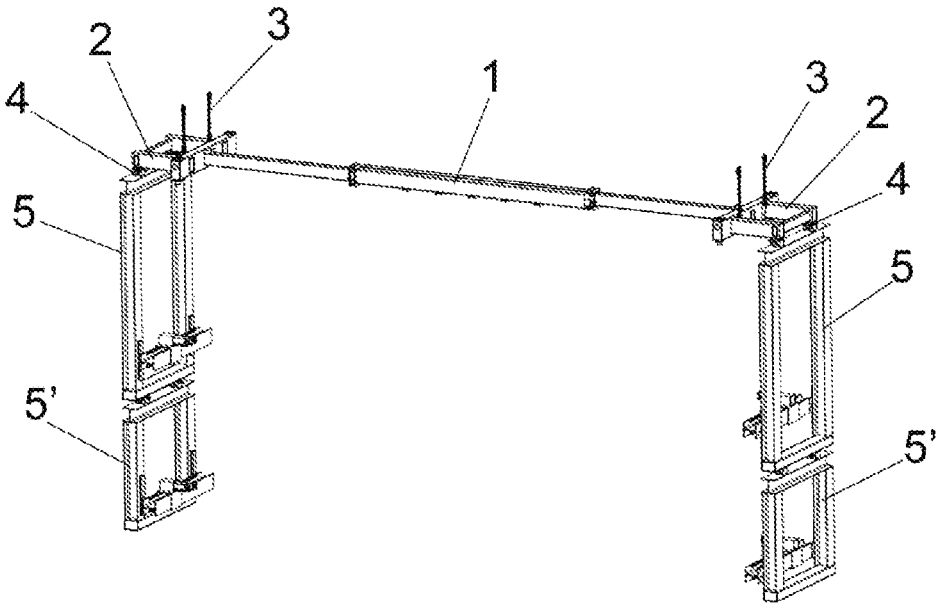
FIG. 1 shows a perspective view of a device for automatically unlocking shipping containers made in accordance with the object of this invention.

In the figures outlined, particularly FIG. 1, it can be seen how the invention's device includes a telescoping horizontal frame (1), capped on both end frames (2), with the setup being upwardly mobile with a port crane (3). It is specially designed in that the end frames (2) are fastened feasibly, more specifically, through securing mechanisms (4) like those used on shipping containers to unlock one or more side frames (5-5').

In the example of FIG. 1, the system includes a first and a second upper side frames (5) and a first and second lower side frames (5') the first and the second lower side frames (5') are shorter to enable unlocking two containers simultaneously, though as many pairs of side frames (5') as necessary could be connected, given the specific needs in each case.

These side frames (5-5') include complementary securing mechanisms (4) at their upper and lower bases.

Figure 2:
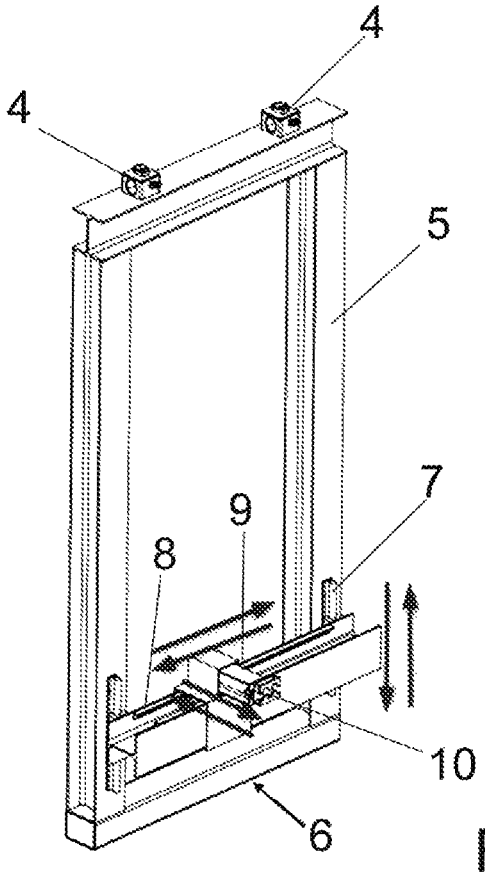
FIG. 2 shows an enlarged detail of one of the side frames of the device. On its inner face is the robotic mechanism that performs unlocking operations.

As can be seen in FIG. 2, a robotic mechanism (6) is set up on the inner face of the first and the second upper side frame (5), formed by a set of rigid links articulated with each other that offer at least three degrees of movement, thereby defining vertical (7), transversal (8) and axial (9) guiding means.

Additionally, the end of this robotic mechanism is capped with a grasping device (10) such as a claw with at least one degree of movement, specially designed to catch on the opening handles (11) of different types of securing mechanisms (12) for the container (13).

As mentioned, this structure is designed to facilitate the relative movement of the tool or claw with respect to the general structure of the side frame (5), with this movement being wide and fast enough to compensate for any unforeseen movement of the containers and for the natural movement of the frame as it moves around the stack of containers.

Figure 3:
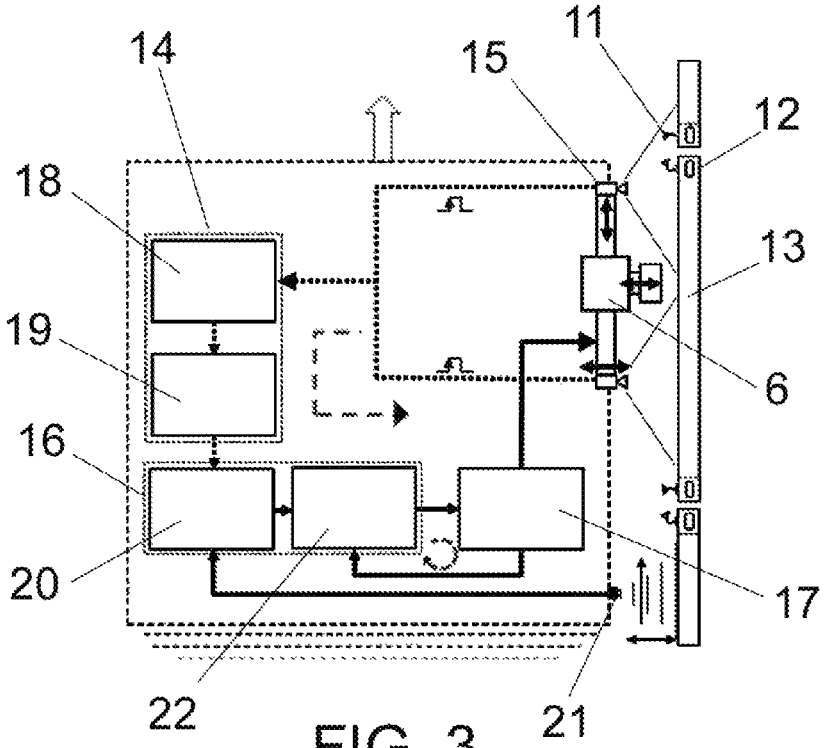
FIG. 3 shows a first alternative for integrating the vision and motion systems for the robotic mechanisms, depending on the control system envisioned for the system.
Figure 4:
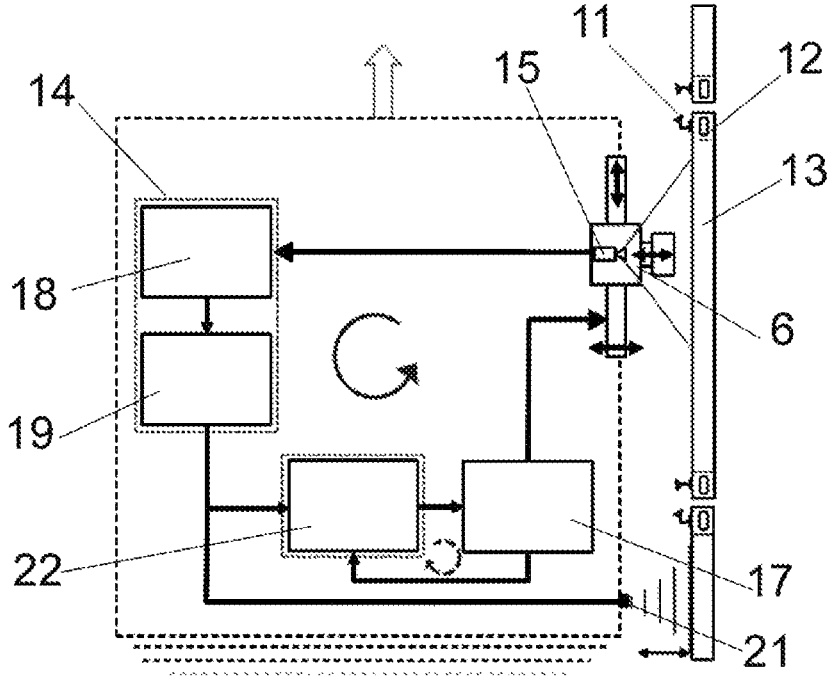
FIG. 4 shows a second alternative for integrating the vision and motion systems for the robotic mechanisms, depending on the control system envisioned for the system.
Figure 5:
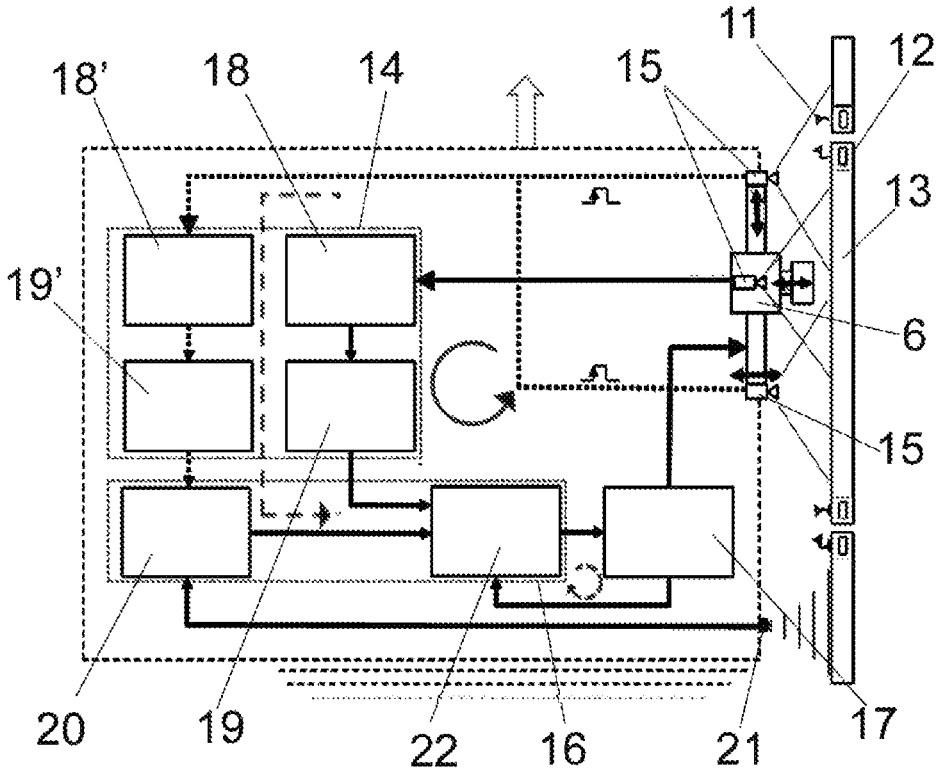
FIG. 5 shows a third alternative for integrating the vision and motion systems for the robotic mechanisms, depending on the control system envisioned for the system.

These robotic mechanisms, which operate independently for each frame, will have tracking, identification, capture, and unlocking functions. For these purposes, they are equipped with an artificial vision system (14) that has one or more cameras (15), with corresponding image processing (18) and coordinate transformation (19), as well as a motion control system (16) and a system for acting (17) on the corresponding robotic mechanism (6), as shown in FIGS. 3 to 5. This way, when a guided action is planned, such as the one shown in FIG. 3, the vision system (14) is responsible for capturing an image of the work area at a pace proportional to the speed of motion of the lifting structure with respect to the containers. Then, the vision system processes (18) the image, determines the presence of any securing mechanisms (12), and sets their position in the image. Subsequently, the motion system—based on the coordinates provided by the vision system, the motion system (16), the frame's speed of motion controlled by a sensor (21), and the separation between the robotic mechanism (6) and the stack of containers—generates the duly controlled (22) trajectory (20) that this robotic mechanism must take to position the capture claw (10) over the opening handle of the target securing mechanism and then carry out the unlocking maneuver.

The embodiment variant in FIG. 4 depicts operation by means of visual servoing. In this form of integration, the vision system (14) captures an image of the work area, identifies the presence of the securing mechanism (12), and determines the position error in Cartesian coordinates (proportional to the difference between the target position and the current position of the end effector of the robotic mechanism). The sampling rate for image capture and error calculation is constant and set beforehand. Then, this information is sent to the motion control system (16) at the same speed, to then generate the control signal (22) to drive the robot's capture claw properly to the point where position error is minimized.

Once the capture claw is located over the opening handle of the securing mechanism (12), the control system handles the unlocking maneuver.

Unlike the guided actuation integration system, where the characteristics of movement are established with an initial image, continuous image acquisition is required for visual servoing. The most external control loop in visual servoing is the image itself, and since there is no trajectory generator in it, images must be acquired and processed continuously to guide the robotic mechanism's end effector.

Finally, in FIG. 5, a hybrid of the solutions shown in FIGS. 3 and 4 is proposed, which has a primary vision system (14) responsible for capturing an initial image of the workspace through cameras (15) with a wide visual field. This initial image is meant to facilitate the first location of the securing mechanisms, and it generates a trajectory that moves the end effector to a more specific target area. Subsequently, a second vision system (18'-19') is responsible for controlling (22) the position of the end effector once it is located over the target area. This subsystem continuously acquires and processes images, and it aims to locate the robotic mechanism's capture claw over the opening handle of the target twistlock.

As a final note, the invention's device offers three modes of operation: remote operation, where a crane operator controls the movement of a lifting frame that supports the robotic mechanism for opening securing mechanisms while one or more stevedores guide the opening of those mechanisms from a safe place at the port; assisted operation, where stevedores have a supervisory responsibility over the process of opening the securing mechanisms, collaborating by calibrating the vision system, confirming the location of the target securing mechanisms, or requesting to reopen the securing mechanisms; and automatic operation, where the robotic mechanism for opening securing mechanisms provide the instrumentation signals needed to guide the crane's movement, which can serve as a support for the crane operator or even as a reference to guide the automatic movement of the lifting frame, where all of the system tasks for opening the securing mechanisms can be carried out alone, without the need for human operators.

The invention claimed is:

1. A device for automatically unlocking shipping containers comprising:

a horizontal frame designed to be moved by a port crane located in a belly of a ship;

a first upper side frame having an upper end located on a first end of the horizontal frame;

a second upper side frame having an upper end located on a second end of the horizontal frame;

a first lower side frame connected to a lower end of the first upper side frame;

a second lower side frame connected to a lower end of the second upper side frame;

the horizontal frame is telescopic to adjust the separation between the first upper and the second upper side frames;

a robotic mechanism located on each one of: the lower end of the first upper side frame, the lower end of the second upper side frame, a lower end of the first lower side frame, and a lower end of the second lower side frame;

wherein each one of the robotic mechanism moves vertically, transversally, and axially;

a grasping device located on each one of the robotic mechanism;

wherein each one of the robotic mechanism works independently from each other to unlock stacked containers simultaneously;

wherein each one of the robotic mechanism unlocks opening handles of a securing mechanism on the respective container;

wherein each one of the robotic mechanism includes an artificial vision system, a motion system, sensors, and a motion control system.

2. The device for automatically unlocking shipping containers according to claim 1, wherein:

the artificial vision system processes an image, determines a presence of securing mechanisms on the shipping containers, and sets position coordinates of each securing mechanism in the image;

the motion control system based on the position coordinates provided by the artificial vision system, the motion system, a frame's speed controlled by the sensor, and separation between each one of the robotic mechanism and the shipping containers, generates a trajectory that each one of the robotic mechanism to position the grasping device over the opening handles of the securing mechanism and then unlocks the shipping container.

* * * * *